US008403064B2

(12) United States Patent
Allen

(10) Patent No.: US 8,403,064 B2
(45) Date of Patent: Mar. 26, 2013

(54) ONE TRIP RETRIEVAL OF A MULTI-ZONE FRACTURING SYSTEM

(75) Inventor: Jason A. Allen, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 595 days.

(21) Appl. No.: 12/698,264

(22) Filed: Feb. 2, 2010

(65) Prior Publication Data

US 2011/0186286 A1 Aug. 4, 2011

(51) Int. Cl.
*E21B 23/00* (2006.01)

(52) U.S. Cl. ..... 166/377; 166/98; 166/387; 166/181

(58) Field of Classification Search ..... 166/377, 166/381, 387, 98, 181, 158, 242.6
See application file for complete search history.

(56) References Cited

U.S. PATENT DOCUMENTS

| | | | | |
|---|---|---|---|---|
| 5,341,880 | A * | 8/1994 | Thorstensen et al. | 166/278 |
| 6,378,609 | B1 | 4/2002 | Oneal et al. | |
| 6,491,104 | B1 * | 12/2002 | Wilie et al. | 166/336 |
| 6,568,474 | B2 * | 5/2003 | George et al. | 166/278 |
| 7,128,151 | B2 | 10/2006 | Corbett | |
| 7,617,880 | B2 * | 11/2009 | Loughlin | 166/387 |
| 2003/0183391 | A1 | 10/2003 | Iosif et al. | |
| 2004/0129419 | A1 * | 7/2004 | Van Wulfften Palthe | 166/278 |
| 2009/0173503 | A1 | 7/2009 | Corbett et al. | |
| 2011/0146988 | A1 * | 6/2011 | McGlothen | 166/297 |

OTHER PUBLICATIONS

Halliburton Completion Tools Brochure, "Sand Control Systems Enhanced Single-Trip Multizone (ESTMZ) System", date unknown, 1-6 pages.
Halliburton Brochure, "Downhole Sand Control Components", date unknown, 1-54 page.
BJ Services Company Product Information, "TIP-PT Packer", Mar. 12, 2003, 1 pages.

* cited by examiner

*Primary Examiner* — Daniel P Stephenson
(74) *Attorney, Agent, or Firm* — Steve Rosenblatt

(57) ABSTRACT

A completion assembly of a top packer and zone isolation packers separated by screens has a disconnect in a selected zone to be fractured or gravel packed that is armed before such a procedure starts. Initially when the assembly of the outer completion and the inner string are properly located and all the screens valved off, all the packers are pressure set and the packer set release device associated with each packer is armed. Before starting a fracturing or gravel packing operation from a given zone isolation packer, a disconnect for that zone packer is armed so that if the inner string sticks in that packer, the inner string is sheared and removed and another trip is used to grab the top packer and pick up. Such picking up releases all the packers down to the one armed disconnect. The disconnect releases bringing up the remnant of the inner string stuck in the packer just above the actuated disconnect.

22 Claims, 7 Drawing Sheets

ONE TRIP RETRIEVAL OF A MULTI-ZONE FRACTURING SYSTEM

FIELD OF THE INVENTION

The field of the invention is a completion system that allows removal of zone isolation packers with a top packer and the screens that separate them down to the zone isolation packer where an inner string gets stuck and doing so in a single trip.

BACKGROUND OF THE INVENTION

Multi-zone fracturing and gravel packing assemblies comprise of an outer assembly that hangs from a top packer and further comprises an alternating pattern of zone isolation packers with screens and gravel exit ports between them. There is an inner assembly of a crossover and wash pipe that is assembled into the outer assembly at the surface so that they are run in together. When the proper depth is reached, the top packer is set and then the other zone isolation packers are set at the same time by pressurizing the outer assembly at a time when all the screens are blocked with valves that can later be selectively opened with a device mounted to the wash pipe. With all the zone isolation packers set, the inner string with the crossover and the wash pipe is positioned with respect to the zone isolation packer above the zone to be fractured and gravel packed.

If during the fracturing or gravel packing operation the inner string gets stuck in the zone isolation packer, there are few options and they are very expensive. In one option the inner string is simply pulled until it shears apart somewhere in the outer completion and the balance of the inner string is pulled out of the hole. Thereafter that portion of the wellbore is abandoned in favor of a deviated bore that is offset from the abandoned hole. The other option calls for again shearing the inner string and then grabbing the top packer and rotating to the right to see which left hand thread at which zone isolation packer releases. If a packer too high up breaks loose then it is pulled to the surface and on another trip the next packer down is tagged and the same procedure is repeated until the zone isolation packer that has the remnant of the stuck remaining portion of the inner string can be reached so that it can be pulled out with the balance of the inner string that is stuck to it. This procedure can potentially cost a lot money depending on how many trips in the hole it takes to finally get down to the packer in question that has the inner string remnant stuck to it. This alternative is rarely used as it is in most cases cheaper to abandon the hole with the stuck pipe and come out with a lateral above it that tracks the orientation of the original abandoned well.

The present invention allows a one trip system that will remove all zone isolation packers with the top packer when all packer release mechanisms are first released and then the top packer is picked up. The system unlocks a disconnect for a zone to be fractured and gravel packed before those procedures start for that zone. Then if that zone is where the inner string got stuck to the zone isolation packer a pickup force on the top packer will release all zone isolation packers down to the zone isolation packer with the remnant of the inner string stuck in it. A breakaway below the packer with the inner string stuck in it will release and the entire outer assembly down to the lowest zone isolation packer that has the inner string remnant stuck in it will come out in a single trip. Those skilled in the art will appreciate other aspects of the invention from a review of the description of the preferred embodiment and the associated drawings while recognizing that the full scope of the invention is to be found in the literal and equivalent scope of the appended claims.

SUMMARY OF THE INVENTION

A completion assembly of a top packer and zone isolation packers separated by screens has a disconnect in a selected zone to be fractured or gravel packed that is armed before such a procedure starts. Initially when the assembly of the outer completion and the inner string are properly located and all the screens valved off, all the packers are pressure set and the packer release device associated with each packer is armed. Before starting a fracturing or gravel packing operation from a given zone isolation packer, a disconnect for that zone packer is armed so that if the inner string sticks in that packer, the inner string is sheared and removed and another trip is used to grab the top packer and pick up. Such picking up releases all the packers down to the one armed disconnect. The disconnect releases bringing up the remnant of the inner string stuck in the packer just above the actuated disconnect.

BRIEF DESCRIPTION OF THE DRAWINGS

FIG. 1 is a view of the completion assembly being run in;

DETAILED DESCRIPTION OF THE PREFERRED EMBODIMENT

Figure 1:
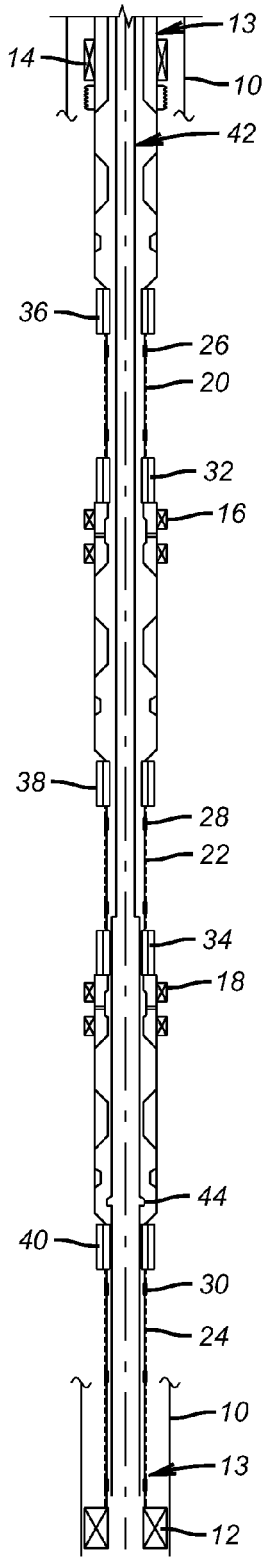

Referring to FIG. 1 there is a casing 10 shown at the top and the bottom of the FIG. 1 and omitted from the other FIGS. for clarity. An optional bottom packer 12 is shown set against the casing 10. An outer assembly 13 starts at the top packer 14 which is schematically shown to be set as FIG. 1 illustrates what happens when the desired depth is reached. The outer assembly 13 ends at the sump packer 12. In between for illustrative purposes are zone isolation packers 16 and 18. Those skilled in the art will understand that additional or fewer isolation packers can be used depending on how many zones are to be treated with a fracture operation and/or a gravel packing operation. Each zone to be treated has at least one schematically illustrated screen such as screens 20, 22 and 24 that are shown for the three zones in FIG. 1. Each screen has a solid base pipe with at least one port covered by a sliding sleeve valve such as schematically illustrated at 26, 28 and 30. In the run in position shown in FIG. 1 all the screens are blocked by valves 26, 28 and 30. This allows the outer assembly to be initially internally pressurized to set the top packer 14 and the zone isolation packers 16 and 18 when the desired depth in the casing or liner 10 is reached.

Each of the zone isolation packers 16 and 18 has a selectively released retraction assembly 32 and 34 respectively. What these assemblies can do after they are armed into the operating mode is that in response to a pulling force delivered through the top packer 14 as will be explained below, the sealing elements and slips on packers 16 and 18 release the sealing grip so that those packers do not resist efforts to pull out the outer assembly 13. The top packer is a known design and as is common in such packers it has a ring that holds the set position of the top packer 14 until it is engaged by a tool to break a shear pin so that the hold of the top packer 14 can be released. It should be noted that the act of setting all the packers 14, 16 and 18 with screens 20, 22 and 24 blocked at valves 26, 28 and 30 will automatically unlock the retraction assemblies that for run in were locked against relative movement. As will be explained below, the internal pressure that sets the packers 14, 16 and 18 also moves a piston that takes support away from a locking dog so that a subsequent upward pull on the top packer will extend the zone isolation packers 16 and 18 to release them for removal from the tubular 10 to the surface.

Above the screen or screens in a given zone between packers or at the bottom of the outer assembly 13, if no sump packer 12 is used, is a selectively armed disconnect such as 36, 38 and 40. During run in these disconnects are locked against relative movement so that the weight of the assembly can go through them without a release. As will be explained in detail below, when it is desired to perform a fracturing or gravel packing operation off of a given packer such as 14, 16 or 18, the act of positioning the inner string assembly 42 on one of these packers activates the movement that releases a dog to allow relative movement that will result in a disconnection at that disconnect if there is an upward pull delivered to the outer assembly 13 through the top packer 14, which at that time has been unset along with any other packer that experience the same removal force. Normally the preferred order of treating zones goes from the bottom up but other orders are within the scope of the invention.

The inner string 42 has a schematically illustrated shifting device 44 that can selectively open valves 26, 28 or 30 to selectively open screens 20, 22 or 24. The inner string assembly 13 also carries a collet to defeat the locks on the disconnects 36, 38 and 40 by being pulled through them and set down on them as will be explained below.

With the major components having been described the operation in broad terms will now be described. The outer tubular assembly 13 and the inner tubular assembly 42 are run in together to the desired location with all screens 20, 22 and 24 closed at valves 26, 28 and 30. The top packer 14 sets first with internal pressure in the outer assembly 13.

Figure 2:
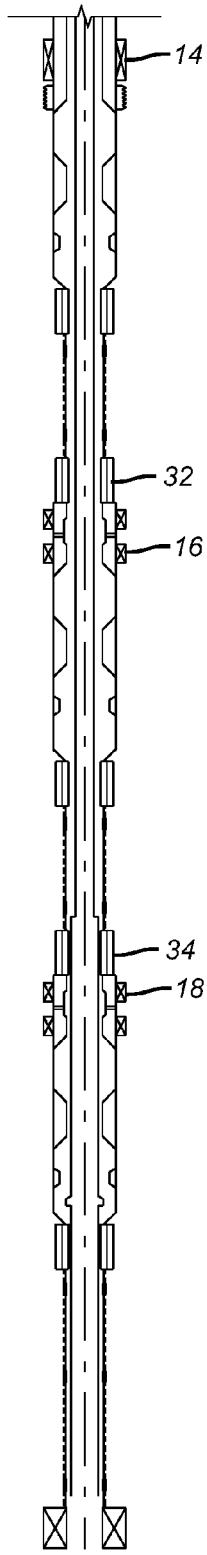
FIG. 2 is the view of FIG. 1 shows all packers set and the release mechanism for all the zone isolation packers below the top packer in the armed position.

As shown in FIG. 2, the top packer 14 is now set and further pressure buildup results in setting the zone isolation packers 16 and 18. As previously mentioned, the packer release devices 32 and 34 that were locked in the FIG. 1 position become unlocked using the same applied pressure in the outer assembly 13 that set the packers 14, 16 and 18. As will be described below, this applied pressure shifts a previously shear pinned piston whose movement removes support for a locking dog that allows an uphole force that is later applied to extend the zone isolation packer that is next to it to release the grip of that packer on the casing or liner 10.

Figure 3:
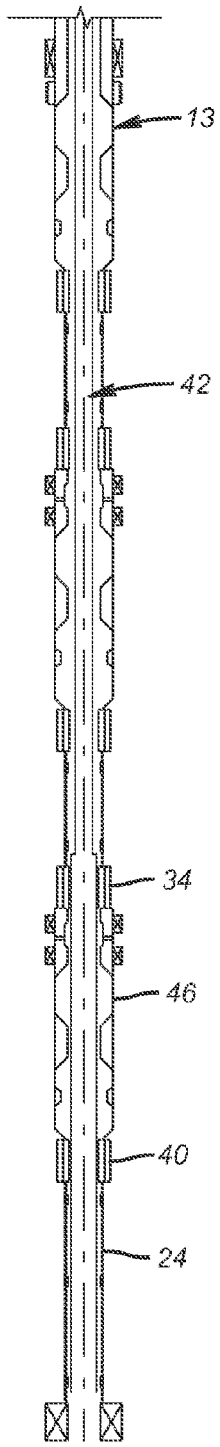
FIG. 3 is the view of FIG. 2 with the inner string landed on the lowermost packer to arm the disconnect associated with that packer.

FIG. 3 shows that the inner string 42 has been positioned with respect to zone isolation packer 18 for a fracturing or gravel packing operation. To do this the inner string is lifted past the packer extension 46 and set back down again. As will be explained below, the act of doing so positions a flexible collet to shift a sleeve to undermine a locking dog so that a disconnect is operative and will respond to a subsequent pickup force to release at disconnect 40 that has been activated by the pass up and then set down movement in the extension 46.

Figure 4:
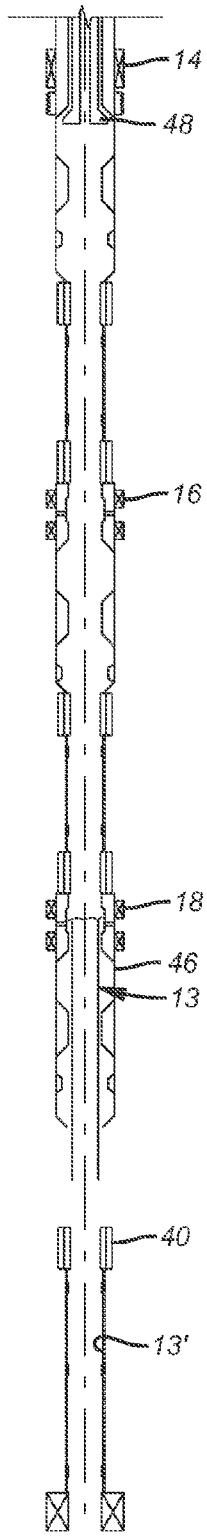
FIG. 4 is the view of FIG. 3 with the inner string stuck in the lower packer having been sheared above that packer and removed and another string run to the top packer to pick it up, which unsets all the packers down to the stuck packer and trips the disconnect for removal from the well.
Figure 6A:
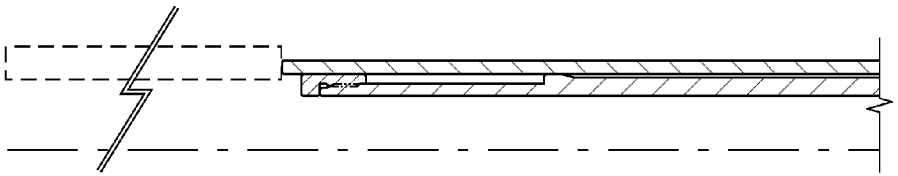
FIGS. 6*a*-6*e* are the view of FIGS. 5*a*-5*e* corresponding to the position in FIG. 2.
Figure 7A:
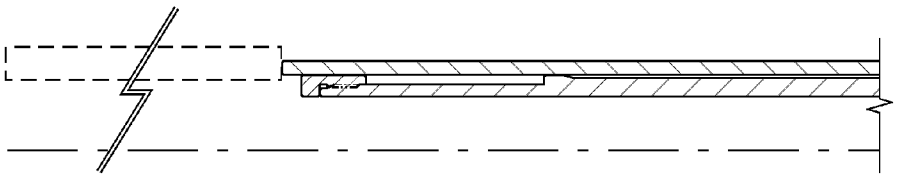
FIGS. 7*a*-7*e* are the view of FIGS. 5*a*-5*e* corresponding to the position in FIG. 3.
Figure 8A:
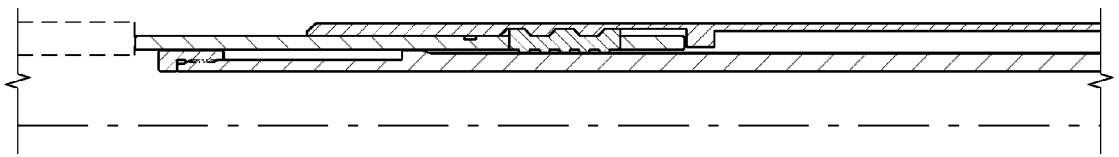
FIGS. 8*a*-8*e* are the view of FIGS. 5*a*-5*e* corresponding to the position in FIG. 4.
Figure 6B:
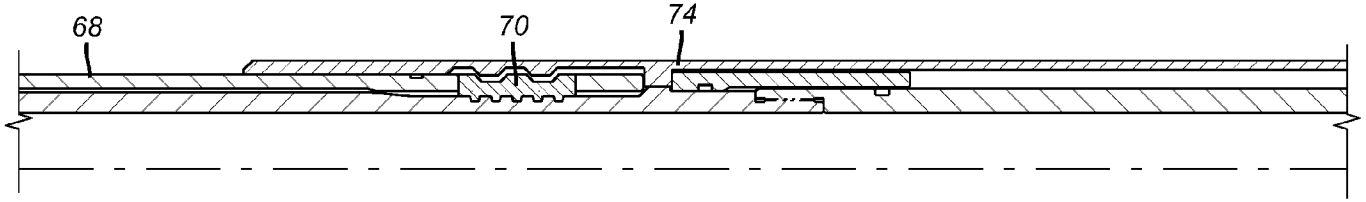
Figure 7B:
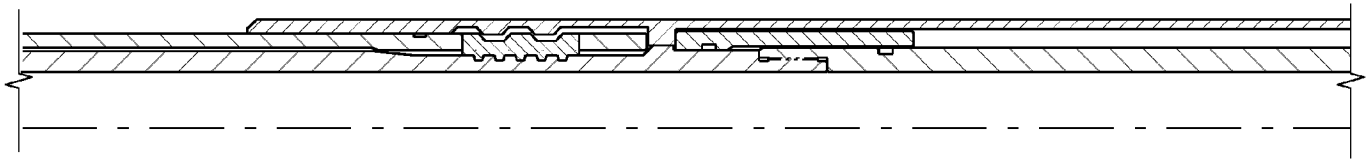
Figure 8B:
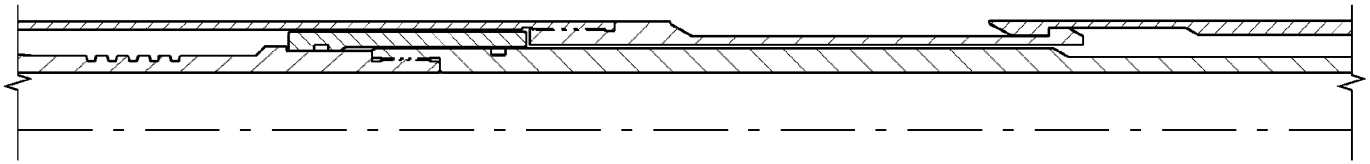
Figure 6C:
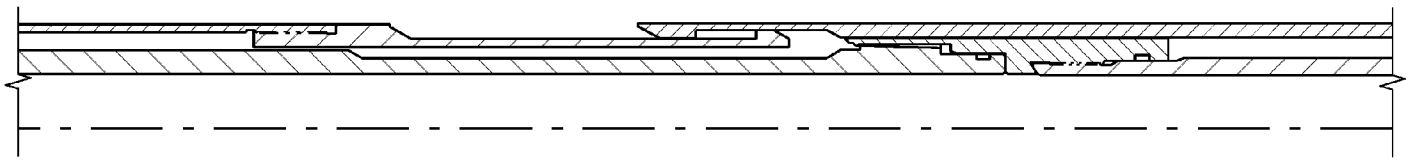
Figure 7C:
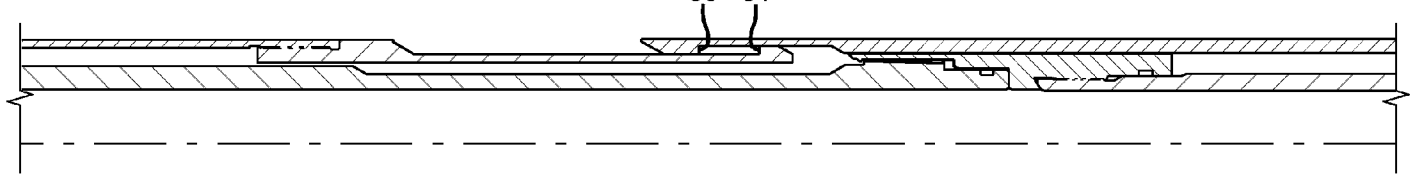
Figure 8C:
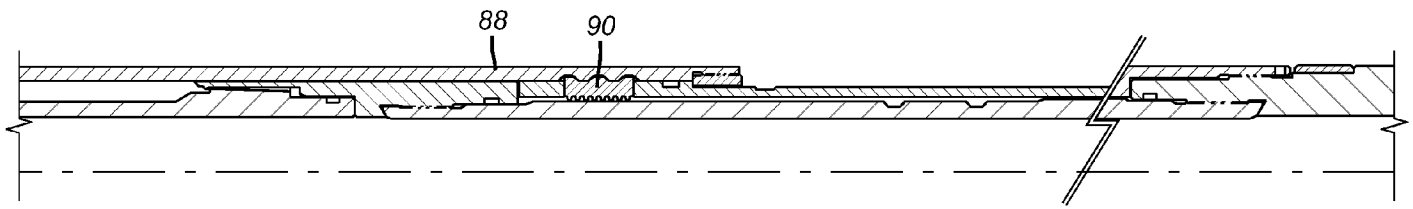

If during the procedure being performed in FIG. 3, the inner string 13 gets stuck then it is picked up until it shears in the vicinity of the location where it has become stuck. The upper portion of the inner string 13 is pulled out leaving the lower segment 13' behind in the packer 18 or its extension 46 as seen if FIG. 4. FIG. 4 shows a release tool 48 has released the top packer 14 by picking up on a release ring in the packer 14 while retaining a grip on packer 14 for a pull up that in turn has not only unset the zone packers 16 and 18 but has also resulted in a disconnect at 40. The same thing happens in any other zone with the only difference being that a different disconnect lets go and that zone isolation packers that are below the disconnect that lets go are not released when the release tool 48 exerts a pickup force at packer 14. In any event the zone isolation packer that has the disconnect operate next to it winds up taking with it the remaining remnant of the inner string 13' so that after that removal the bottom hole assembly can be rebuilt back down to the disconnect that released or the zone or zones that have been completed could then simply be produced by running a production string to them. This can be done by having an overshot land on the remaining portion of the disconnect in a way that creates a seal with another packer just above the overshot. The replacement completion assembly can then go in above this newly inserted bottom packer.

FIGS. 5-8 show a detailed view from a screen such as 22 to a disconnect such as 40 with a zone isolation packer 18 in between. Since the layout is modular the interval could also be representative of another location but it is used here to illustrate the operation of the packer release device such as 34 and the disconnect such as 40. Packer 18 is shown schematically in FIG. 5*a* in the run in position. The weight of the packer 18 is carried by a series of sleeves marked in an uphole direction as 60, 62, 64, 66 and 68. In FIG. 5*b* the weight is transferred to sleeve 68 through a dog 70 that sits in a window 72 in sleeve 68. Outer sleeve 74 has ridges 76 that line up with peaks 78 to keep dog 70 in window 72 and up against the sleeve 66 so that the weight of the packer 18 transfers to the sleeve 68. Outer sleeve 74 moves with piston 80 when pressure is applied at port or ports 82. Sleeve 68 in FIG. 5*a* hangs off the screen 22. With the dog 70 in the FIG. 5*a* position the outer sleeve 74 and the bottom sub 82 that has a shoulder 84 cannot move to get closer to shoulder 86 on the packer release sleeve 88. FIG. 5*d* shows the lower end of the release sleeve 88 and how it interfaces with the known design of the setting lock mechanism on the pressure set packer 18. Briefly, the release sleeve 88 retains a dog 90 to hold the set of the packer 18 when pressure is applied. When pressure is applied the packer 18 is set and its set position is retained by the release sleeve 88 over the dog 90. That same pressure that has set packer 18 (as well as all the other packers) has also through passage 82 (omitted in the other views for clarity) moved the piston 80 and the outer sleeve 74 to the point where the dog 70 has become unsupported as shown in FIG. 6*b*. At this time an upward pull on the sleeve 68 will pick up outer sleeve 74 and bottom sub 82 until the shoulder 84 catches shoulder 86 so that the release sleeve 88 can come up and undermine dog 90 to stretch out packer 18 so that it lets go as can best be seen by comparing FIG. 5*d* with 8*c*.

Figure 5A:
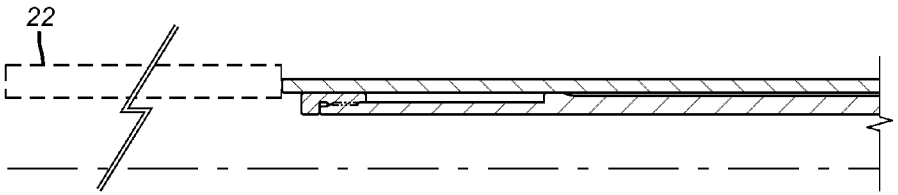
FIGS. 5*a*-5*e* correspond to a detailed view of FIG. 1 showing a span between two screen sections.
Figure 5B:
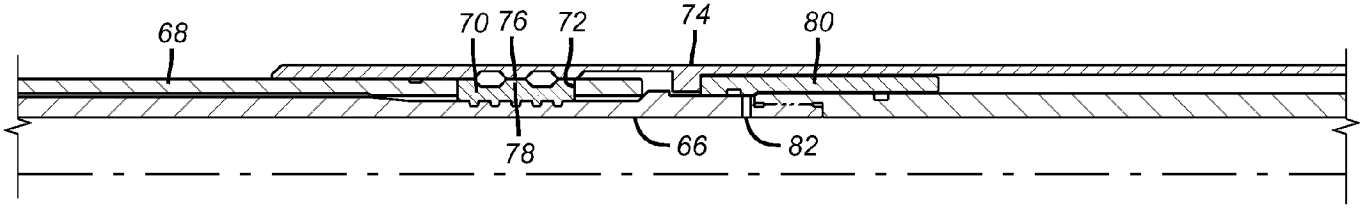
Figure 5C:
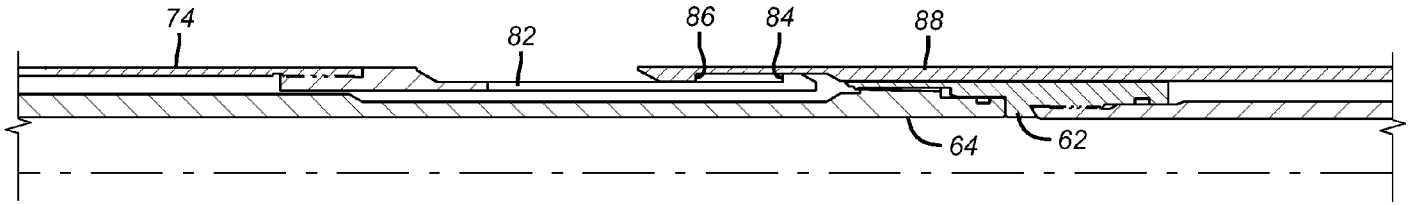
Figure 5D:
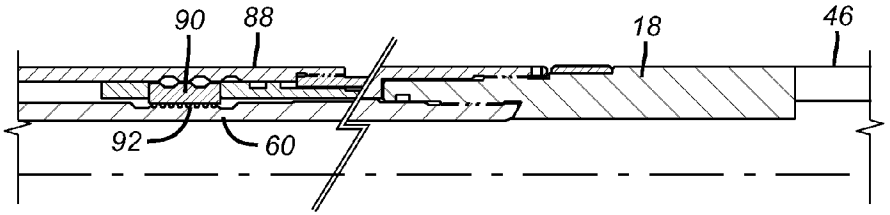
Figure 6D:
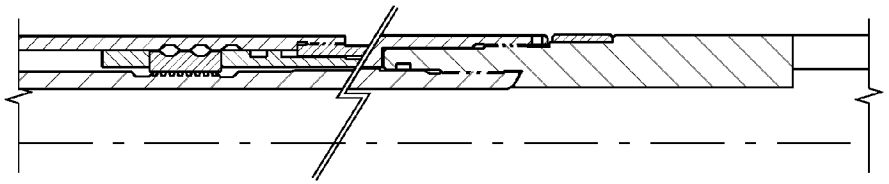
Figure 7D:
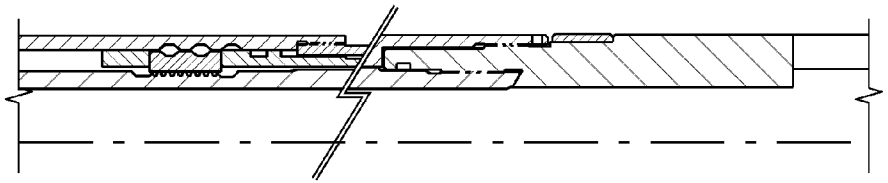
Figure 8D:
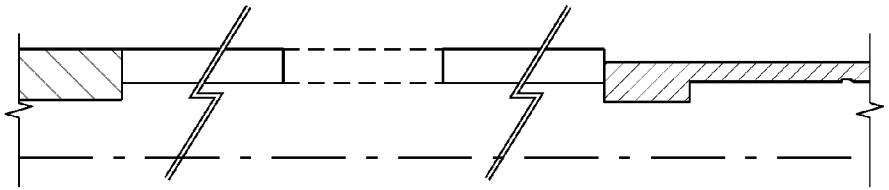
Figure 5E:
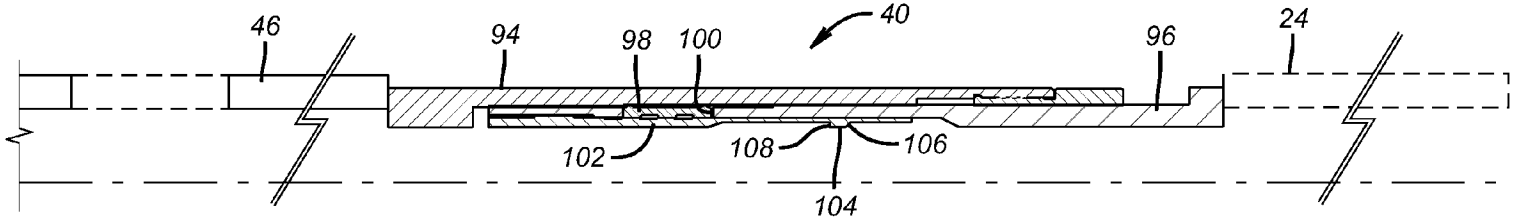
Figure 6E:
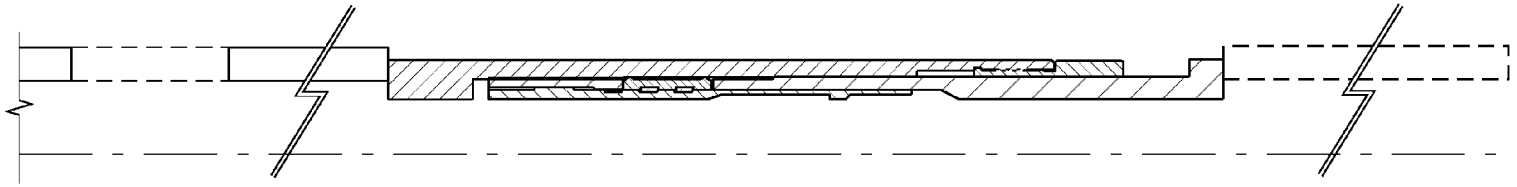
Figure 7E:
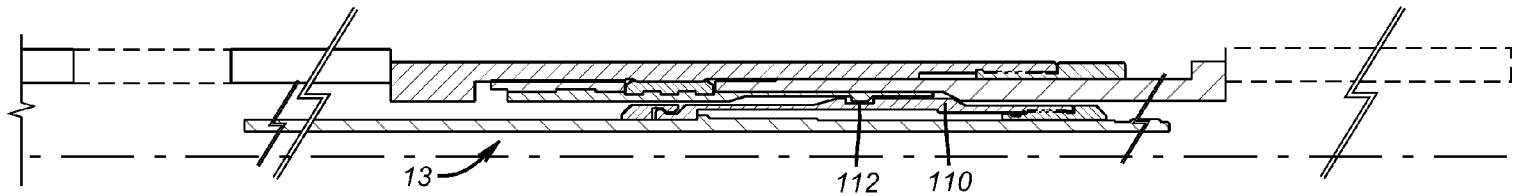
Figure 8E:
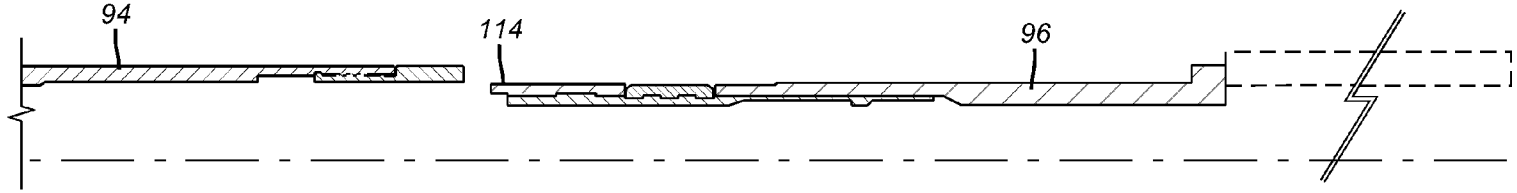

Continuing now to FIGS. 5*d* and 5*e*, the packer extension 46 is shown leading to the disconnect 40, below which is screen 24. Disconnect 40 has an outer member 94 held to an inner member 96 by a dog 98 in a window 100 held there by sleeve 102. Sleeve 102 has a ring 104 that has a lower end taper 106 and an upper end square shoulder 108. Referring to FIG. 7*e*, the inner assembly 13 has a flexible collet assembly 110 that has a square shouldered groove 112. When the inner assembly 13 is moved up the end taper 106 allows the collet assembly 110 to pass without groove 112 engaging the ring 104. When the inner string is set down again, the square shouldered groove 112 grabs the ring 104 and takes it down with the sleeve 102. The dog 98 is released and an upward pull to member 94 allows it to come up and away from member 96 as shown in FIG. 8*e*. As stated before an overshot can be landed on end 114 and a replacement bottom hole assembly attached or a production string for producing the zone or zones that have already been completed. It should now be clear how setting the packers arms the release mechanism for them and how selecting a zone to complete arms the disconnect that is associated with the packer that defines the upper end of the zone selected. With each packer release activated on packer setting and the release for the designated zone to be completed armed before the completion in that zone begins, the sticking of the inner assembly allows it to be sheared with a remnant left in the packer that has an armed disconnect associated with it. Upon a pickup force applied by a release tool in the top packer, the top packer down to the armed disconnect will come out taking with it the remnant of the inner string stuck in the lowest packer or extension that will be coming out.

Those skilled in the art will appreciate that the above described assembly allows for the ability to unset zone isolation packers that are above an armed disconnect. The specific disconnect to be armed is selected before a zone associated with it is fractured or gravel packed. If the inner string then gets stuck in that zone the top of it down to the location where it is stuck is sheared off and a retrieval tool unsets the top packer and all zone isolation packers down to the armed disconnect so that the remnant of the inner string that is stuck in the packer associated with the disconnect that breaks loose can bring up the remnant with it. The zones already completed can then be produced or the remaining zones can then be completed with another assembly of an outer assembly with an inner assembly run back in to tag the disconnect that previously let go and the completion process for those zones can take place.

The above description is illustrative of the preferred embodiment and many modifications may be made by those skilled in the art without departing from the invention whose scope is to be determined from the literal and equivalent scope of the claims below.

I claim:

1. A completion assembly for subterranean use, comprising:

an outer assembly comprising at least one packer supporting at least one screen assembly disposed in at least producing one zone to be completed;

an inner assembly movably mounted within said outer assembly for selectively directing fluid to said zone;

at least one disconnect between said packer and said screen selectively enabled by movement of said inner assembly before a completion operation in said zone to allow selective removal of said packer and any portion of said inner assembly supported by said packer.

2. The assembly of claim 1, wherein:

said disconnect is selectively locked with a disconnect lock.

3. The assembly of claim 1, wherein:

said at least one packer and at least one screen and at least one zone each comprise a plurality of packers, screens and zones with a packer and screen associated with a discrete zone;

said at least one disconnect comprises a plurality of disconnects with one disposed in each of said zones between a packer and a screen.

4. A completion assembly for subterranean use, comprising:

an outer assembly comprising at least one packer supporting at least one screen assembly disposed in at least producing one zone to be completed;

an inner assembly movably mounted within said outer assembly for selectively directing fluid to said zone;

at least one disconnect between said packer and said screen to allow selective removal of said packer;

removal of said packer brings out at least a portion of said inner assembly that is stuck in said packer.

5. A completion assembly for subterranean use, comprising:

an outer assembly comprising at least one packer supporting at least one screen assembly disposed in at least producing one zone to be completed;

an inner assembly movably mounted within said outer assembly for selectively directing fluid to said zone;

at least one disconnect between said packer and said screen to allow selective removal of said packer;

said disconnect is selectively locked with a disconnect lock;

said disconnect lock is selectively unlocked by movement of said inner assembly after said packer is set.

6. The assembly of claim 5, wherein:

movement of said inner assembly to position it allow fluid to reach said zone defeats said disconnect lock, whereupon a pulling force separates said disconnect.

7. The assembly of claim 6, wherein:

said disconnect comprises an inner and outer sleeve held together by at least one dog in a window of said inner sleeve and said dog is secured in said window by a shifting sleeve selectively movable by said inner assembly.

8. The assembly of claim 7, wherein:

said inner assembly comprises at least one flexible collet that moves in a first direction past said shifting sleeve without moving it and when movement of said inner assembly is reversed said collet operably engages said shifting sleeve for tandem movement to remove support for said dog.

9. A completion assembly for subterranean use, comprising:

an outer assembly comprising at least one packer supporting at least one screen assembly disposed in at least producing one zone to be completed;

an inner assembly movably mounted within said outer assembly for selectively directing fluid to said zone;

at least one disconnect between said packer and said screen to allow selective removal of said packer;

a lock in a packer release mechanism mounted adjacent said packer, said packer release mechanism allowing release of said packer for removal of said outer assembly.

10. The assembly of claim 9, wherein:

said lock is defeated when said packer is set.

11. The assembly of claim 10, wherein:

said packer is set and said lock in said packer release mechanism is defeated with pressure in said outer assembly.

12. The assembly of claim 11, wherein:

said screen is selectively blocked with a blank base pipe having at least one valved port selectively opened with movement of said inner assembly.

13. The assembly of claim 11, wherein:

said packer is extended by said packer release mechanism after its lock is unlocked and a force is applied;

said application of pressure shifts a piston to un-support a dog to allow a release sleeve in said packer release mechanism to initially move relative to said packer in response to a subsequently applied force for extending the packer to enable its removal.

14. A completion assembly for subterranean use, comprising:

an outer assembly comprising at least one packer supporting at least one screen assembly disposed in at least producing one zone to be completed;

an inner assembly movably mounted within said outer assembly for selectively directing fluid to said zone;

at least one disconnect between said packer and said screen to allow selective removal of said packer;

said at least one packer and at least one screen and at least one zone each comprise a plurality of packers, screens and zones with a packer and screen associated with a discrete zone;

said at least one disconnect comprises a plurality of disconnects with one disposed in each of said zones between a packer and a screen;

said disconnects are initially locked against separation until movement of said inner assembly into a position to deliver fluid to a respective zone below one of said packers unlocks said disconnect associated with that packer to make that disconnect operative in response to an applied force to separate.

15. The assembly of claim 14, wherein:

each said packer further comprises a packer release mechanism and an associated lock that is in a locked position for initial placement of said outer assembly.

16. The assembly of claim 15, wherein:

all of said locks on said packer release mechanisms are unlocked when all said packers are set.

17. The assembly of claim 16, wherein:

said packers are set with pressure in said outer assembly made possible by blank pipe with closed valved ports under said screens with said ports subsequently opened by movement of said inner string.

18. The assembly of claim 17, wherein:

said application of pressure shifts a piston to un-support a dog to allow a release sleeve in each said packer release mechanism to initially move relative to a respective packer in response to a subsequently applied force for extending said packers to enable their removal down to said unlocked disconnect.

19. The assembly of claim 17, wherein:

each said disconnect comprises an inner and outer sleeve held together by at least one dog in a window of said inner sleeve and said dog is secured in said window by a shifting sleeve selectively movable by said inner assembly.

20. The assembly of claim 19, wherein:

said inner assembly comprises at least one flexible collet that moves in a first direction past said shifting sleeve without moving it and when movement of said inner assembly is reversed said collet operably engages said shifting sleeve for tandem movement to remove support for said dog.

21. The assembly of claim 16, wherein:

a force applied to said outer assembly releases all said packers until said force reaches an unlocked disconnect so that said outer assembly down to said unlocked disconnect can be removed.

22. The assembly of claim 21, wherein:

said outer assembly down to said unlocked disconnect can be removed with at least a portion of said inner assembly that is stuck in said packer and extends past said unlocked disconnect.

* * * * *